United States Patent [19]

Karl et al.

[11] Patent Number: 4,938,684

[45] Date of Patent: Jul. 3, 1990

[54] ON-OFF BURNER CONTROL BY CYCLE TIME VARIATION

[75] Inventors: Nolte Karl, Essen; Detlef Maiwald, Moers, both of Fed. Rep. of Germany; Michael Bock, Pittsburgh, Pa.; Thomas Spahr, Hungen-Nonnenrohr, Fed. Rep. of Germany

[73] Assignee: LVE Verfahrenselektronik GmbH, Essen, Fed. Rep. of Germany

[21] Appl. No.: 400,575

[22] Filed: Aug. 30, 1989

[30] Foreign Application Priority Data

Sep. 1, 1988 [DE] Fed. Rep. of Germany ..... 3829677

[51] Int. Cl.[5] ..... F23C 11/04

[52] U.S. Cl. ..... 431/1; 236/46 F; 431/75

[58] Field of Search ..... 236/46 F, 15.8 B, 75; 431/1, 75; 122/24; 251/129.05

[56] References Cited

U.S. PATENT DOCUMENTS 3,219,095 11/1965 Nilsson ..... 251/129.05
4,552,304 12/1985 Papazian ..... 236/46 F
4,583,936 4/1986 Krieger ..... 431/1

*Primary Examiner*—William E. Wayner

*Attorney, Agent, or Firm*—Blakely, Sokoloff, Taylor & Zafman

[57] ABSTRACT

The burners of a fuel-fired system are controlled by means of a feedback control system for temperature control. The control system comprises temperature measuring means, a controller for temperature control, final burner controlling means translating the output from the controller into an appropriate burner input rate, and a digital central processing unit determining pulse spacing ($t_{ps}$), pulse duration (tON) and pulse separation (tOFF). A minimum pulse spacing ($t_{ps_{min}}$), being the sum of the minimum pulse duration ($tON_{min}$) and the minimum pulse separation ($tOFF_{min}$), is present and used as an input rate reference value. Using the input rate reference value for the minimum pulse spacing, the burner input rate is controlled in accordance with process requirements by varying pulse spacing ($t_{ps}$) through varying pulse separation or pulse duration. For input rates lower than the input rate reference value, pulse separation is increased, and for input rates higher than the input rate reference value, pulse duration is increased with pulse separation remaining the minimum pulse separation. The feedback control system substantially improves the rangeability of burners controlled by ON-OFF control systems, minimizing pulse spacing and achieving correspondingly rapid response.

19 Claims, 4 Drawing Sheets

SET POINT INPUT RATE 1%
→ MINIMUM ON TIME / MAXIMUM OFF TIME

SET POINT INPUT RATE 1%-XX%
→ MINIMUM ON TIME / OFF TIME BEING REDUCED

SET POINT INPUT RATE XX%
→ MINIMUM ON TIME / MINIMUM OFF TIME → HIGHEST FREQUENCY

SET POINT INPUT RATE XX%-99%
→ MINIMUM OFF TIME / ON TIME BEING INCREASED

SET POINT INPUT RATE 1%
→ MINIMUM ON TIME/MAXIMUM OFF TIME

SET POINT INPUT RATE 1%-49%
→ MINIMUM ON TIME / OFF TIME BEING REDUCED

SET POINT INPUT RATE 50 %
→ MINIMUM ON TIME / MINIMUM OFF TIME → HIGHEST FREQUENCY

SET POINT INPUT RATE 51%-99%
→ MINIMUM OFF TIME / ON TIME BEING INCREASED

ON-OFF BURNER CONTROL BY CYCLE TIME VARIATION

BACKGROUND OF THE PRESENT INVENTION

1. Field of the Invention

The present invention relates to the field of the control of burners of a fuel-fired system and, more specifically, to the control of the input rate of ON-OFF burners by varying the cycle time (hereinafter referred to as "pulse spacing").

2. Prior Art

It has been state of the art to vary a directly controlled variable by shifting the trailing edge of the ON-pulse to vary the duty factor correlating the pulse duration and the pulse separation, keeping the pulse spacing constant. If such a control method is adopted, both the pulse duration and the pulse separation are changed. However, if said control method is applied to control ON-OFF-controlled burners of a fuel-fired system, it is a disadvantage that such burners can only be operated at medium load, since burners will only emit oxides of nitrogen at a relatively low rate, and other combustion conditions will only be satisfactory, if said burners remain ON for a first minimum period, depending on burner design, forming part of the total firing cycle, and remain OFF for a second minimum period also depending on burner design. The useful (medium-load) range for the operation of such burners could be widened by increasing the time length of the total firing cycle, but such an increase would cause the response of the control system to be slower. The present invention has remedied said disadvantage.

SUMMARY OF THE PRESENT INVENTION

It is an object of the present invention to improve the rangeability of burners used in a fuel-fired system while achieving satisfactory burner operating and combustion conditions and keeping the total firing cycle short in order not to affect system response.

The present invention describes a system for the control of ON-OFF-controlled burners for controlling the temperature in a fuel-fired system. For temperature control, the burners of said fuel-fired system are controlled by a feedback control system. Said control system comprises temperature measuring means, a controller for temperature control and final controlling means translating the controller output value into an appropriate burner input rate as well as a digital central processing unit determining pulse spacing, the duration of the burner ON-pulse and ON-pulse separation. A minimum pulse spacing, being the sum of a minimum pulse duration and a minimum pulse separation, is preset and used as an input rate reference value. Using said input rate reference value for said minimum pulse spacing, the burner input rate may be controlled in accordance with process requirements by varying said pulse spacing through varying either said pulse separation or said pulse duration. To obtain an input rate lower than said reference value, pulse separation is increased, and to obtain an input rate higher than said reference value, pulse duration is increased, keeping pulse separation constant at its minimum value, thereby substantially improving the rangeability of an ON-OFF-controlled burner, minimizing pulse spacing and thus ensuring fast response.

Unlike conventional control systems for ON-OFF-controlled burners, the control system divulged by the present invention varies either pulse separation or pulse duration whenever the input rate is varied. Whenever any such input rate variation is made, the second portion of the pulse spacing (either the pulse duration or the pulse separation) is maintained at its preset minimum value. Pulse spacing will thence be altered and no longer be equal to the minimum pulse spacing whenever an input rate variation is made. It is an important advantage of the present invention, proposing the simultaneous variation of pulse spacing and duty factor, that the rangeability of the ON-OFF-controlled burners controlled in accordance with the teachings of the present invention is fully exploited without affecting combustion behavior, pulse spacing always being minimized for the input rate set. If said input rate is high, pulse separation is at a minimum and if said input rate is low, pulse duration is at a minimum. It is a further advantage of the present invention that the ON-time or the OFF-time will never be shorter than the minimum ON-time or the minimum OFF-time, as the case may be, even if the deviation output signal representing deviations between the measured values and the set point values changes suddenly.

A particularly fast response is achieved in an embodiment of the present invention by presetting a minimum pulse spacing equal to the sum of a minimum pulse duration and a minimum pulse separation adapted to the burner being controlled. Said presetting, and the input rate reference value allocated thereto, correspond substantially to the middle of the useful range in which said burner may be operated, with pulse frequency being highest at said presetting. Whenever a higher input rate is required for adequate process operation, pulse separation is kept at its minimum value and pulse duration is increased, and whenever a lower input rate is required for adequate process operation, pulse duration is kept at its minimum value and pulse separation is increased.

In an alternative embodiment of the present invention, a maximum pulse duration is preset, the input rate reference value being the maximum input rate, and the actual input rate is controlled by varying pulse separation, keeping said maximum pulse duration constant.

According to another aspect of the present invention, the method divulged herein may easily be adapted to different fuel-fired systems by selecting pulse duration and pulse separation presettings individually for the final controlling means being used and/or for the fuel-fired process being controlled and storing the values so preset in a memory, a microprocessor being used to form actual pulse durations and actual pulse separations, employing the parameters so stored and thereby controlling the input rate. In a preferred embodiment of the present invention the control of all final burner controlling means, respectively valves, of a fuel-fired system is synchronized by a microprocessor with respect to pulse positions and duty factors.

A fuel-fired system so controlled may be employed for heating or alternately heating and cooling, and the control of the valves of all burners or other valves of such a fuel-fired system may be out of phase but synchronized if separate control circuits are provided.

In a preferred embodiment of the present invention, the central processing unit is mounted on a plug-in unit and coupled with the control means and the final burner controlling means via input interface means and output interface means respectively. Said plug-in unit is provided with a front panel on which display means, input means and operator control means are arranged, said input means and said operator control means being used to input parameter values and, more specifically, minimum pulse durations and minimum pulse separations, the phase angles of valves controlled separately, data to select one of a multitude of set point generating devices and/or data to select one of a multitude of channels used to control several fuel-fired systems being operated by one common central processing unit.

A central processing unit as proposed by the present invention may be used virtually for any fuel-fired system provided that the parameters stored in the programmable memory are changed as may be required. The same plug-in unit may thus be used for different fuel-fired systems and for any input rate. The present invention may hence be exploited, for example, to operate a furnace designed for a temperature of 1400° C. at, for instance, a temperature of 140° C. without affecting combustion quality and thus to use said furnace at such a low temperature as a reheating furnace.

Further details of the present invention are revealed in the claims hereinbelow, and it is apparent to any person versed in the art that any such details released in said claims may be combined in accordance with the teachings of the present invention.

BRIEF DESCRIPTION OF THE DRAWINGS

The present invention will now be described with the help of preferred embodiments illustrated in the accompanying drawings in which.

DETAILED DESCRIPTION OF THE PRESENT INVENTION

A system for the improved control of ON-OFF-controlled burners or burner groups used in a fuel-fired system is described. In the following description, numerous specific details are set forth, such as numbers of burners or other components, burner rangeabilities and details of the configuration and arrangement of display means and operator control means, etc., in order to provide a thorough understanding of the present invention. It will be obvious, however, to one skilled in the art that the present invention may be practiced without these specific details. In other cases, well-known circuits and structures have not been described in detail in order not to unnecessarily obscure the present invention.

Figure 1:
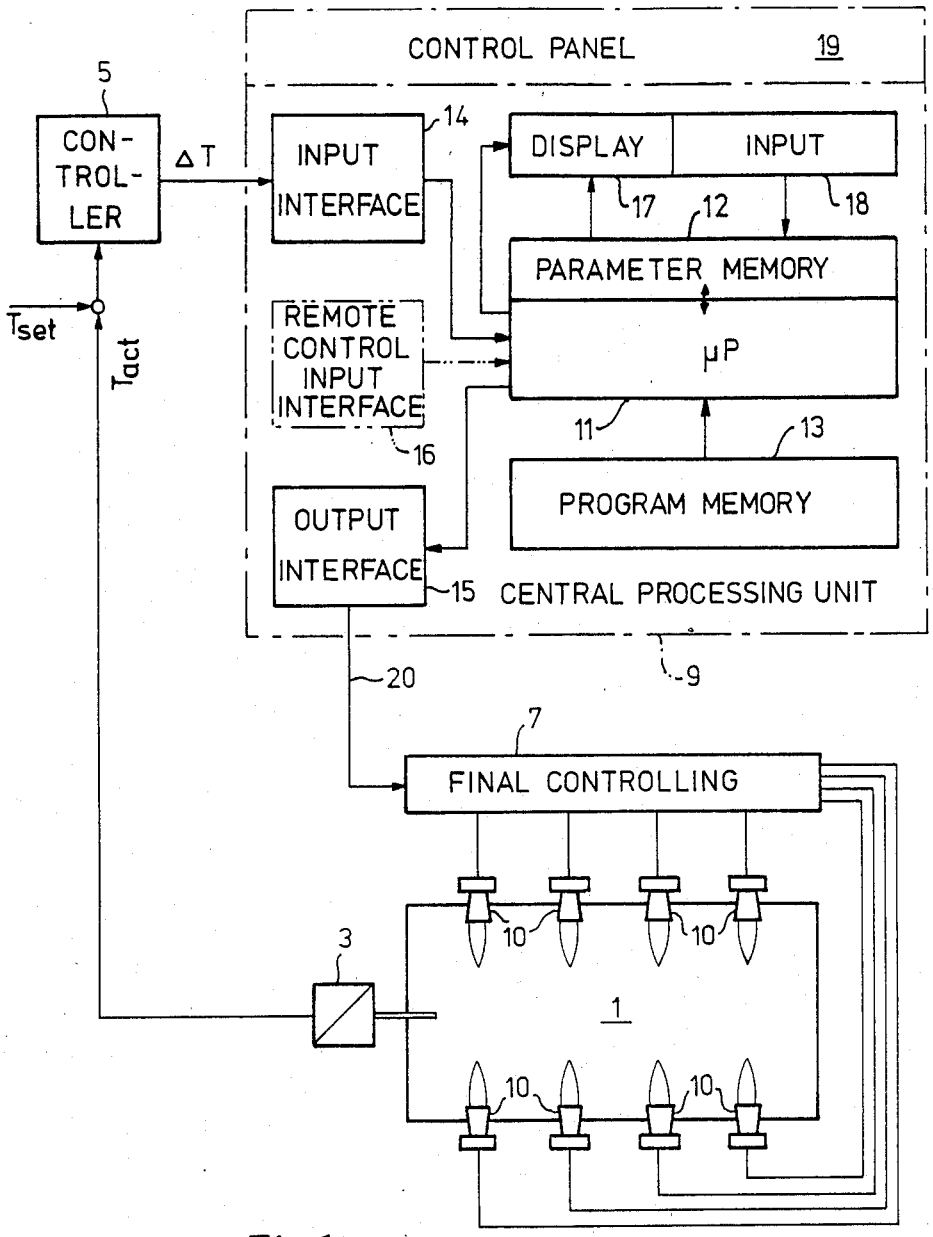
FIG. 1 is a block schematic diagram showing an embodiment of the present invention as used for controlling a furnace equipped with burners controllable by an ON-OFF control system.

Referring first to FIG. 1, a block schematic diagram of a control loop for a fuel-fired system 1 is shown. Said loop comprises temperature measuring means 3, a controller 5, comparing an actual temperature $T_{act}$ derived from said measuring means with a preset set point temperature $T_{set}$ and generating an output signal $\Delta T$ representing the deviation between said actual temperature and said set point temperature, and final burner controlling means 7. Said means 7 controls the ON-time and the OFF-time of the eight ON-OFF-controlled burners 10 with which the furnace 1 is provided in the embodiment of the present invention depicted in FIG. 1 in response to the deviation $\Delta T$ so that the actual temperature $T_{act}$ measured in said furnace 1 is maintained at the preset set point temperature $T_{set}$. An arrangement of such a kind is known from prior art and is used in conventional furnace engineering design.

According to the teachings of the present invention, a central processing unit 9 is included in the control loop between the output of controller 5 and the control signal input (line 20) of the final controlling means 7 controlling burners 10. In the embodiment of the present invention depicted in FIG. 1, said central processing unit 9 comprises a microprocessor 11 with an integrated electrically erasable programmable read-only memory, a read-only memory 13 serving as a program memory, an input interface 14 coupled with controller 5 and microprocessor 11, an output interface 15 with an appropriate output driver coupled with said microprocessor 11 and the final burner controlling means 7, a remote control input interface 16, display means 17 and appropriate input and operator control means 18 for parameter input. Said display, input and operator control means are coupled with the programmable memory and the central processing unit and mounted on a control panel 19.

Referring now to FIGS. 2 and 3, the pulse diagrams presented therein provide an understanding of the control method proposed by the present invention.

FIG. 2 depicts a method of controlling the ON-OFF-controlled burners 10 using a central processing unit 9 acting upon final burner controlling means 7 by varying pulse spacing $t_{ps}$ to obtain different input rates over a wide range. FIGS. 2A through 2D show pulse trains representing burner ON-times tON and burner OFF-times tOFF for different input rates corresponding to different pulse spacings $t_{ps}$. The pulses in the diagrams correspond to electric signals sent by central processing unit 9 via output interface 15 through line 20 to final controlling means 7, said final controlling means 7 controlling fuel flow to burners 10. The times of pulse duration and pulse separation depicted schematically in said FIGS. 2A through 2D correspond to the times in which such electric signals are present or absent and thence to the ON-times or OFF-times of said burners 10.

Figure 2A:
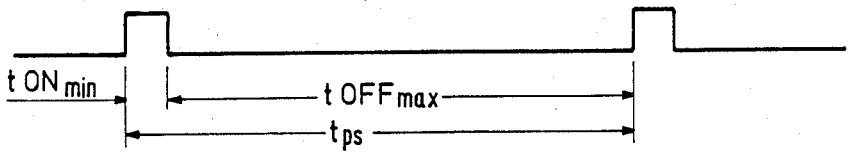
FIGS. 2A–2D are pulse diagrams representative of a first mode of operation.

FIG. 2A represents the minimum input rate for the described embodiment equal to 1% of the maximum input rate, the pulse duration being set for the minimum ON-time $tON_{min}$ being a characteristic preset value for each ON-OFF-controllable burner 10. The OFF-time tOFF corresponding to the separation between two consecutive pulses is at a maximum for a minimum input rate, the pulse spacing $t_{ps}$ in FIG. 2A, representing the minimum input rate, being equal to the sum of $tON_{min}$ and $tOFF_{max}$.

Figure 2B:
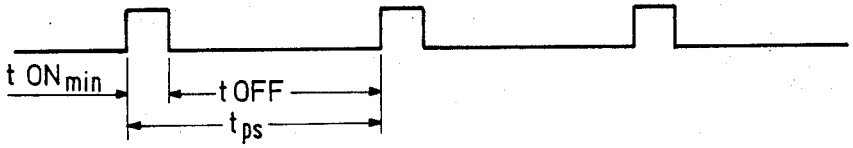

Referring now to FIG. 2B, the burner input rate is increased relative to the burner input rate set by the pulse sequence depicted in FIG. 2A. To achieve said increase, the OFF-time tOFF between two consecutive pulses is decreased, whereas the ON-time corresponding to the pulse duration is maintained at the minimum ON-time level $tON_{min}$. The pulse spacing $t_{ps}$ is hence also reduced by a time equal to said decrease in said OFF-time.

Figure 2C:
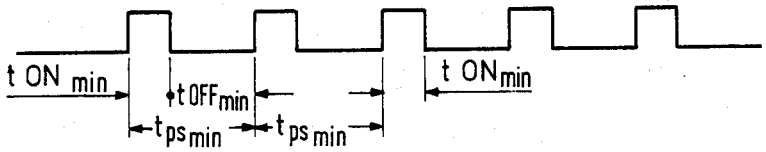
Figure 2D:
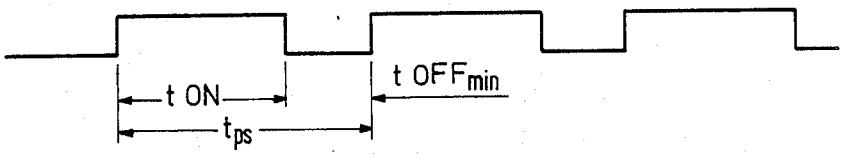

Referring to FIG. 2C next, the diagram shows the pulse train with the minimum pulse spacing. For the minimum pulse spacing $t_{psmin}$ equivalent to an input rate of XX %, both the ON-time and the OFF-time are set at the shortest intervals allowed by the burner manufacturer. The operating conditions depicted in FIG. 2C are preset in the programmable memory and serve as reference conditions. If the input rate is increased relative to the above XX %, then the control system will not vary the OFF-time tOFF, but vary, that is increase, the pulse duration corresponding to the ON-time tON, whereas the OFF-time is maintained at the minimum OFF-time level $tOFF_{min}$, the pulse spacing $t_{ps}$ increasing by the same amount as the ON-time tON (see FIG. 2D). The methods of varying pulse separation or pulse duration depicted schematically in FIG. 2 hence allow the variation of input rates over a wide range hitherto not achieved without decreasing ON-times and OFF-times below the minimum ON-times and the maximum OFF-times admitted for a specific burner and the consistent minimization of pulse spacing, thereby keeping response times short.

Referring now to FIG. 3, the mode of operation presented therein is typical of the application of the present invention to a fuel-fired system used for heating and cooling, the air valves and the fuel valves being controlled separately, but in a synchronized mode. The input rates depicted in FIGS. 3A through 3D are similar to the input rates depicted in FIGS. 2A through 2D. In both applications shown to provide a clear understanding of the present invention, the input rate is initially at its lower limit (as in the case depicted in FIG. 3A) and then first increased by decreasing the OFF-time tOFF, and thereafter, upon reaching an input rate reference value set at 50% of the maximum input rate in the example presented in FIG. 3, said OFF-time having been decreased to the minimum OFF-time $tOFF_{min}$ is kept constant and the input rate is increased further by increasing pulse duration. Unlike the mode of operation depicted in FIG. 2, the operating mode shown in FIG. 3 provides for the separate control of the air valves and the fuel valves. The air valve of each burner is opened at time $t_1$ prior to burner ignition, ignition being then initiated, whereas fuel valve opening is delayed by a constant delay $t_d$. Fuel flow is further interrupted before air flow.

Figure 3A:
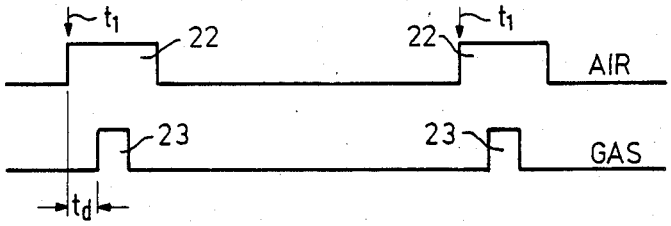
FIGS. 3A–3D are pulse diagrams representative of a second mode of operation.
Figure 3B:
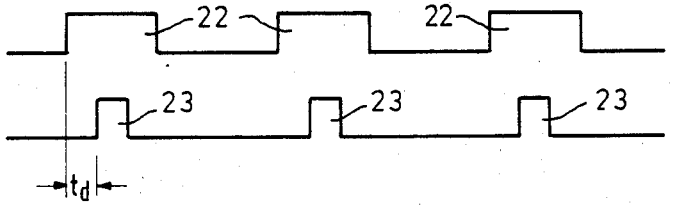
Figure 3C:
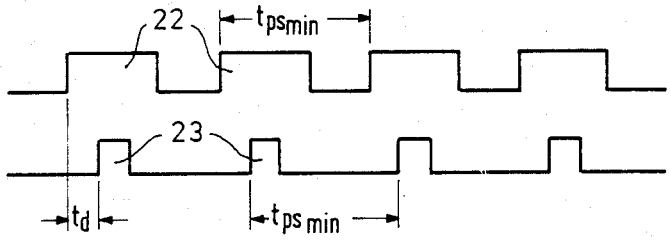
Figure 3D:
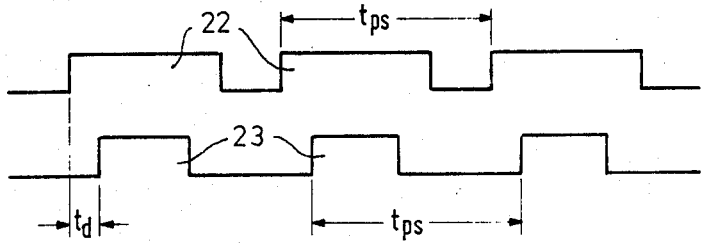

As FIGS. 3A through 3C show, the input rate is increased to an input rate of 50% of the maximum input rate by decreasing pulse separation both between consecutive air pulses 22 and consecutive fuel pulses 23, the durations of pulses 22 and 23 remaining at their minimum values as the input rate is being increased. Upon reaching the input rate reference value, as shown in FIG. 3C, the OFF-time is at its minimum and the pulse train frequency is highest for the burners used in the application, the train frequency and the pulse spacing $t_{ps}$ being in agreement in the case of synchronized air and fuel control. As process input rate requirements increase further beyond said 50%, the OFF-time is kept at a minimum, while the ON-time is increased.

Further modes of operation, such as heating with variable pulse durations and pilot burner/main burner operation and heating with variable pulse separations and separate air valve and fuel valve control, may be implemented using pulse configurations similar to those presented in FIG. 3, with only the delays of the synchronized pulses 22 and 23 being different.

Under certain conditions, it may be appropriate to control heating, heating/cooling and/or pilot burner/main burner functions using a fixed (maximum) pulse duration and a variable pulse spacing corresponding to a variable pulse separation. Rangeability would then substantially correspond to the difference between FIG. 2C and FIG. 2A, the fixed pulse ON-time being $tON_{max}$ rather than $tON_{min}$.

If an appropriate multi-channel arrangement is selected, the central processing unit 9 may furnish different pulse trains for the control of different groups of burner valves or other control valves. All pulses forming part of pulse trains derived from the central processing unit 9 and carried by one channel are synchronized with each other irrespective of any phase shifts, as the principle depicted in FIG. 3 demonstrates.

Figure 4:
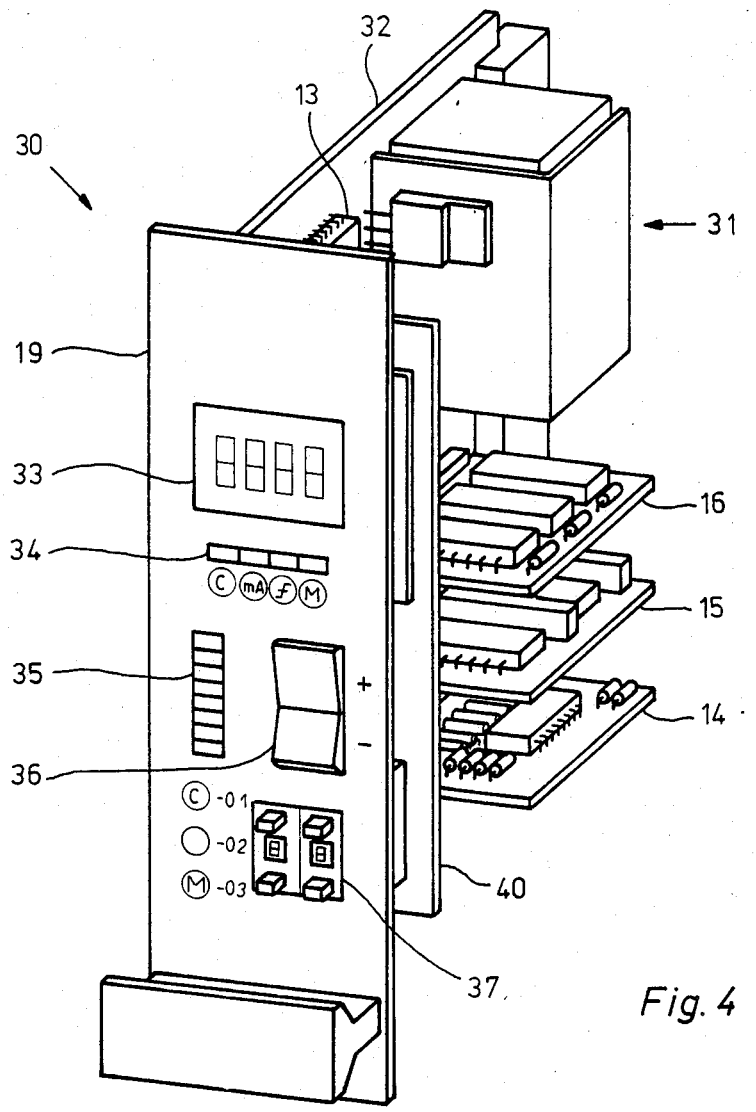
FIG. 4 is a view of a central processing unit mounted on a plug-in unit provided with a front plate carrying operator control means, input means and display means.

The central processing unit with all associated input means, display means and operator control means is mounted on a plug-in unit 30 shown in FIG. 4. Said plug-in unit is provided with a main card frame 32 carrying the power supply unit 31 and the main functional assemblies represented by the blocks in FIG. 1. The different interfaces 14 through 16 are cards known from other applications and inserted in appropriate slots of card frame 32. The microprocessor 11, 12, the read-only memory 13 and the power supply unit 31 are mounted directly on said frame 32. The interfaces and the driver circuitry for the operator control, input and display means visible on the control panel 19 are integrated in board 40 on the rear side of said panel 19. The display means includes a four-digit display window 33 which shows the actual input rate when the central processing unit is in the operational mode and the applicable parameter values while parameters are being inputted and may also be used for check display during maintenance work. A set point input display unit 34 is arranged below said four-digit display window 33, said display unit 34 having light-emitting diodes to indicate the set point source providing set point input. If "C" is lit, then controller 5 is a computer and the set point temperature is being inputted via serial interface 16, if "mA" is lit, then controller 5 is a continuous controller, if the third light-emitting diode is lit, then set point input is by a three-step controller, and if "M" is lit, then set point input is manual. A further display arrangement 35 is provided with a total of eight light-emitting diodes to indicate what output driver is being addressed by the central processing unit. A rocker switch 36 is also provided in the front panel for manual set point input rate input and for the input or modification of parameters such as minimum pulse durations and minimum pulse separations. Depending on the direction in which the switch is actuated, the parameter or value selected is increased or decreased by increments. A selector switch 37 is provided to select the set point input rate input mode or to select parameters. The push buttons may also be used to select the mode of operation.

The different operator control and input functions described hereinabove allow the adaptation of the central processing unit 9 mounted on the plug-in unit 30 for any ON-OFF-controlled burner or group of burners. Said adaptation may be made easily by any user actuating switches 36 and 37 provided for parameter input. For protection against unauthorized parameter input, the system may be safeguarded by a security code, blocking programmable memory 12.

What we claim is:

1. In a fuel-fired system, including at least one burner controllable by an ON-OFF control system and operated at a variable pulse spacing comprising two portions which consist of a pulse duration and a pulse separation, a method of controlling said at least one burner, said method comprising the steps of:

presetting a minimum pulse spacing, said minimum pulse spacing consisting of a predetermined pulse duration (tON) and a minimum pulse separation;

allocating an input rate reference value to said minimum pulse spacing;

substantially keeping constant one of the two pulse spacing portions consisting of said pulse duration and said pulse separation; and varying said pulse spacing through varying the other one of said two pulse spacing portions to control the burner input rate, said controlled input rate being correlated with said input rate reference value.

2. A method according to claim 1 further comprising the step of determining a minimum pulse duration adapted to said at least one burner of said fuel-fired system wherein said minimum pulse spacing is equal to the sum of said minimum pulse duration and said minimum pulse separation.

3. A method according to claim 2 wherein said input rate is increased relative to said input rate reference value by maintaining said minimum pulse separation and increasing said pulse duration and wherein said input rate is decreased relative to said input rate reference value by maintaining said minimum pulse duration and increasing said pulse separation.

4. A method according to claim 1 wherein said predetermined pulse duration is a preset maximum pulse duration and said input rate reference value is a maximum input rate and wherein said input rate is controlled by varying said pulse separation, keeping said maximum pulse duration constant.

5. A method according to claim 1 further comprising the step of storing the values of said pulse spacing, said pulse duration and said pulse separation as parameters in a memory.

6. A method according to claim 5 wherein the values of said pulse spacing, said pulse duration and said pulse separation are selected individually for each specific fuel-fired system provided with any such at least one burner and said values so selected are stored in said memory.

7. A method according to claim 6 wherein at least one final controlling means is provided for burner control and wherein a microprocessor is provided for pulse duration and pulse separation forming and coupled with each such final controlling means to control the input rate for said at least one burner controllable by an ON-OFF control system.

8. A method according to claim 7 wherein said microprocessor generates synchronized output pulses to the final controlling means of all burners of said fuel-fired system.

9. A method according to claim 8 further comprising the step of generating output pulses to control a multitude of valves being part of said fuel-fired system wherein the pulse positions and the duty factors of all such output pulses are in a synchronized relationship.

10. A method according to claim 1 wherein said at least one burner controllable by an ON-OFF control system heats a furnace.

11. A method according to claim 10 wherein said furnace is alternately heated and cooled.

12. In a fuel-fired system, including at least one furnace chamber, at least one burner controllable by an ON-OFF control system for heating said furnace chamber and a feedback control system, said feedback control system having measuring means to measure at least one temperature in said furnace chamber, control means to generate an output signal representing deviations between measured values and set point values, memory means to store a process control program and process control parameters and final controlling means to receive a sequence of pulses and to determine a further pulse spacing, an improved method of controlling said at least one burner controllable by an ON-OFF control system, said method comprising the steps of providing a processor coupled with said control means, said memory means and said final controlling means to process data from said control means and said memory means and to send pulse sequences to said final burner controlling means;

inputting an input rate range, appropriate for said burner, between a minimum input rate and a maximum input rate into said memory means;

determining a minimum pulse spacing for said pulse sequences, said minimum pulse spacing consisting of a predetermined pulse duration and a minimum pulse separation;

inputting said minimum pulse spacing into said memory means and allocating an input rate reference value to said minimum pulse spacing; and monitoring by said processor said output signal representing deviations between measured values and set point values and varying said pulse spacing in said pulse sequences through varying one of the two pulse spacing portions consisting of said pulse duration and said pulse separation to vary the input rate and to reduce deviation.

13. An improvement according to claim 12 wherein ranges are selected for the variations of said pulse spacing, said pulse duration and said pulse separation for the specific final controlling means being used and wherein said ranges are stored in said memory.

14. In a fuel-fired system, including at least one burner controllable by an ON-OFF control system and a feedback control system, said feedback control system having measuring means for temperature measurement, control means to generate an output signal representing deviations between measured values and set point values, memory means to store a process control program and process control parameters, at least one final burner controlling means and a processor coupled to receive deviation values from said control means, to retrieve process control program and process control parameter data from said memory means and to send pulse sequences to said final burner controlling means, an improvement comprising a central processing unit being integrated in said feedback control system between at least one control means output and one final burner controlling means input, said central processing unit comprising a read-only memory for storing a process control program, a programmable memory for inputting and retrieving process control parameters and said processor coupled with said two memories and arranged so that said processor may send pulse sequences of different pulse spacings to said final burner controlling means, each such pulse spacing comprising two portions consisting of a pulse separation and a pulse duration, wherein one of said two pulse spacing portions is varied to vary said pulse spacing and wherein said pulse spacing is so varied in accordance with said process control program in response to output signals received from said control means and parameters retrieved from said programmable memory.

15. An improvement according to claim 14 further comprising a plug-in unit carrying said central processing unit, said central processing unit further having input interface means coupled with said control means and output interface means coupled with said final burner controlling means.

16. An improvement according to claim 15 further comprising input means, operator control means and display means, said plug-in unit having a front panel on which at least some of the components of said input means, said operator control means and said display means are accessibly arranged.

17. An improvement according to claim 16 wherein said input interface means comprises several inputs which may separately receive separate set point input values and wherein said output interface means comprises separate outputs which are coupled with separate final burner controlling means and may be driven separately to control the burners.

18. An improvement according to claim 15 wherein said plug-in unit comprises a card frame having slots to accommodate several cards and wherein the circuitry associated with each such interface is arranged on a separate card and each such card is detachably placed in slots of said card frame.

19. An improvement according to claim 14 further comprising a front panel carrying display and operator control components and a rocker switch, said rocker switch being provided for parameter input.

* * * * *